US008206522B2

(12) United States Patent
Sandstrom et al.

(10) Patent No.: US 8,206,522 B2
(45) Date of Patent: Jun. 26, 2012

(54) NON-TOXIC, HEAVY-METAL FREE SENSITIZED EXPLOSIVE PERCUSSION PRIMERS AND METHODS OF PREPARING THE SAME

(75) Inventors: Joel Sandstrom, Corcoran, MN (US); Aaron A Quinn, Coon Rapids, MN (US); Jack Erickson, Andover, MN (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 12/751,607

(22) Filed: Mar. 31, 2010

(65) Prior Publication Data

US 2011/0239887 A1 Oct. 6, 2011

(51) Int. Cl.

| | |
|---|---|
| ***C06B 33/00*** | (2006.01) |
| ***C06B 33/08*** | (2006.01) |
| ***C06B 25/18*** | (2006.01) |
| ***D03D 23/00*** | (2006.01) |
| ***D03D 43/00*** | (2006.01) |

(52) U.S. Cl. ..... 149/109.4; 149/37; 149/38; 149/96; 149/108.2; 149/109.2

(58) Field of Classification Search ..... 149/109.4, 149/37, 38, 96, 108.2, 109.2
See application file for complete search history.

(56) References Cited

U.S. PATENT DOCUMENTS

| | | | | |
|---|---|---|---|---|
| 998,007 | A | | 7/1911 | Imperiali |
| 2,194,480 | A | * | 3/1940 | Pritham et al. ..... 149/29 |
| 2,231,946 | A | | 2/1941 | Rechel et al. |
| 2,349,048 | A | | 5/1944 | Mackey et al. |
| 2,649,047 | A | | 8/1953 | Silverstein |
| 2,929,699 | A | | 3/1960 | Audrieth et al. |
| 2,970,900 | A | | 2/1961 | Woodring et al. |
| 3,026,221 | A | | 3/1962 | Krist |
| 3,113,059 | A | | 12/1963 | Ursenbach |
| 3,181,463 | A | | 5/1965 | Morgan et al. |
| 3,275,484 | A | | 9/1966 | Foote et al. |
| 3,367,805 | A | | 2/1968 | Clay et al. |
| 3,420,137 | A | | 1/1969 | Staba |
| 3,437,534 | A | | 4/1969 | McEwan et al. |
| 3,488,711 | A | | 1/1970 | Dany et al. |

(Continued)

FOREIGN PATENT DOCUMENTS

| | | |
|---|---|---|
| DE | 2513735 | 10/1975 |

(Continued)

OTHER PUBLICATIONS

Busky, et al., "Non-Toxic Heavy Metal Free Primers for Small Arms Cartridges—Red Phosphorous Base", presented May 8, 2007.

(Continued)

*Primary Examiner* — James McDonough
(74) *Attorney, Agent, or Firm* — Patterson Thuente Christensen Pedersen, P.A.

(57) ABSTRACT

A non-toxic, non-hydroscopic percussion primer composition and methods of preparing the same, including at least one explosive component that has been traditionally considered a moderately insensitive explosive or secondary explosive, and at least fuel particle component having a particle size of about 1.5 microns to about 12 microns, which allows the use of moderately active metal oxidizers. The sensitivity of the primer composition is created by the interaction between the moderately insensitive explosive and the fuel agent such that traditional primary explosives such as lead styphnate or DDNP are not needed. The primer composition also eliminates the risks and dangers associated with traditional nano-sized fuel particles.

29 Claims, 1 Drawing Sheet

U.S. PATENT DOCUMENTS

| | | | | |
|---|---|---|---|---|
| 3,634,153 | A | 1/1972 | Perkins et al. | |
| 3,650,856 | A | 3/1972 | Artz | |
| 3,707,411 | A | 12/1972 | Gawlick et al. | |
| 3,726,217 | A | 4/1973 | Dedman et al. | |
| 3,755,019 | A | 8/1973 | Huskins et al. | |
| 3,767,488 | A | 10/1973 | Staendeke et al. | |
| 3,904,451 | A | 9/1975 | Rainone | |
| 4,014,719 | A | 3/1977 | Wells | |
| 4,133,707 | A | 1/1979 | Andrew | |
| 4,142,927 | A | 3/1979 | Walker et al. | |
| 4,145,969 | A | 3/1979 | Gawlick et al. | |
| 4,196,026 | A | 4/1980 | Walker et al. | |
| 4,304,614 | A | 12/1981 | Walker et al. | |
| 4,315,897 | A | 2/1982 | Staendeke et al. | |
| 4,336,085 | A | 6/1982 | Walker et al. | |
| 4,428,292 | A | 1/1984 | Riggs | |
| 4,522,665 | A | 6/1985 | Yates, Jr. et al. | |
| 4,554,031 | A | 11/1985 | Kerviel et al. | |
| 4,581,082 | A | 4/1986 | Hagel et al. | |
| 4,698,215 | A | 10/1987 | Albanesi et al. | |
| 4,728,375 | A | 3/1988 | Simpson | |
| 4,853,288 | A | 8/1989 | Staendeke et al. | |
| 4,963,201 | A | 10/1990 | Bjerke et al. | |
| 4,976,793 | A | 12/1990 | Zimmermann | |
| 5,027,707 | A | 7/1991 | Mei | |
| 5,167,736 | A | 12/1992 | Mei et al. | |
| 5,216,199 | A | 6/1993 | Bjerke et al. | |
| 5,316,600 | A | 5/1994 | Chan et al. | |
| 5,388,519 | A | 2/1995 | Guindon et al. | |
| 5,417,160 | A | 5/1995 | Mei et al. | |
| 5,449,423 | A | 9/1995 | Cioffe | |
| 5,466,315 | A | 11/1995 | Erickson et al. | |
| 5,522,320 | A | 6/1996 | Dillehay | |
| 5,557,061 | A | 9/1996 | Ramaswamy | |
| 5,567,252 | A | 10/1996 | Mei et al. | |
| 5,610,367 | A | 3/1997 | Erickson et al. | |
| 5,672,219 | A | 9/1997 | Rinaldi et al. | |
| 5,684,268 | A | 11/1997 | Lopata | |
| 5,717,159 | A | 2/1998 | Dixon et al. | |
| 5,780,768 | A | 7/1998 | Knowlton et al. | |
| 5,831,208 | A | 11/1998 | Erickson | |
| 5,939,661 | A | 8/1999 | Bayliss | |
| 6,057,264 | A | 5/2000 | Bradbury | |
| 6,066,214 | A | 5/2000 | Comfort | |
| 6,165,294 | A | 12/2000 | Fogelzang et al. | |
| 6,322,648 | B2 | 11/2001 | Rayer et al. | |
| 6,478,903 | B1 | 11/2002 | John, Jr. et al. | |
| 6,544,363 | B1 | 4/2003 | Erickson | |
| 6,581,520 | B1 | 6/2003 | Koch et al. | |
| 6,588,344 | B2 | 7/2003 | Clark et al. | |
| 6,612,242 | B2 | 9/2003 | Raupp et al. | |
| 6,620,267 | B1 | 9/2003 | Guindon et al. | |
| 6,641,683 | B1 | 11/2003 | McKenney, Jr. et al. | |
| 6,645,625 | B2 | 11/2003 | Horold et al. | |
| 6,663,731 | B1 | 12/2003 | Rose et al. | |
| 6,878,221 | B1 | 4/2005 | Mei et al. | |
| 7,129,348 | B1 | 10/2006 | Wardle et al. | |
| 7,192,649 | B1 | 3/2007 | Jouet et al. | |
| 7,670,446 | B2 | 3/2010 | Puszynski et al. | |
| 2002/0127403 | A1* | 9/2002 | Horold et al. | 428/403 |
| 2002/0129724 | A1 | 9/2002 | Clark et al. | |
| 2005/0183805 | A1* | 8/2005 | Pile et al. | 149/39 |
| 2005/0189053 | A1* | 9/2005 | Pile et al. | 149/108.6 |
| 2005/0224147 | A1 | 10/2005 | Jung et al. | |
| 2006/0060273 | A1 | 3/2006 | Smith | |
| 2006/0113014 | A1 | 6/2006 | Puszynski et al. | |
| 2006/0219341 | A1 | 10/2006 | Johnston et al. | |
| 2006/0272756 | A1 | 12/2006 | Kneisl et al. | |
| 2007/0102076 | A1* | 5/2007 | Redecker et al. | 149/36 |
| 2008/0245252 | A1* | 10/2008 | Erickson et al. | 102/204 |
| 2010/0116385 | A1 | 5/2010 | Johnston et al. | |
| 2011/0000390 | A1 | 1/2011 | Erickson et al. | |

FOREIGN PATENT DOCUMENTS

| | | |
|---|---|---|
| DE | 19606237 | 8/1996 |
| EP | 0070932 | 2/1983 |
| EP | 0283759 | 9/1988 |
| EP | 0334725 | 9/1989 |
| EP | 0699646 | 3/1996 |
| EP | 0911366 | 4/1999 |
| EP | 0952130 | 10/1999 |
| EP | 1195366 | 4/2002 |
| EP | 0737174 | 9/2004 |
| WO | WO9515298 | 6/1995 |
| WO | WO9612770 | 5/1996 |
| WO | WO9944968 | 9/1999 |
| WO | WO0121558 | 3/2001 |
| WO | WO0206421 | 1/2002 |
| WO | WO2006009579 | 1/2006 |
| WO | WO2006083379 | 8/2006 |
| WO | WO2008/100252 | 8/2008 |
| WO | WO2009/102338 | 8/2009 |
| WO | WO2011/123437 | 10/2011 |

OTHER PUBLICATIONS

Definition of "composition", Hackh's Chemical Dictionary, 4th Edition. Copyright 1969 by Mc-Graw Hill, Inc. New York, NY.

Definition of "mixture", The American Heritage College Dictionary, 3rd Edition. Copyright 2000 by Houghton Mifflin.

Horold, Sebastian, "Improvements in Stability of Red Phosphorous", 27th International Pyrotechnic Seminar Proceedings, Jul. 2000, Grand Junction Colorado, Copyright 2000 IPSUSA.

Levitas, Valery I, et al., "Mechanochemical mechanism for fast reaction of metastable intermolecular composites based on dispersion of liquid metal", J. Appl. Phys. vol. 101, pp. 083524-1 through 083524-20, 2007.

Railsback, Bruce, "An Earth scientist's periodic table of the elements and their ions,"Geology, pp. 737-740, Sep. 2003.

Railsback, Bruce, "An earth scientist's periodic table of the elements and their ions,"Version 4.8, University of Georgia, Athens, Georgia, Copyright 2007. http://www.gly.uga.edu/railsback/PT.html.

Rovner, Sophie, "How a Lubricant Additive Works", chemical & Engineering News, vol. 83, No. 11, p. 10 Copyright 2005.

Ostrowski et al., "AL/MoO3 Primer Evaluation Tests Part II: Delay Cartridges," American Institute of Aeronautics nad Astronautics, AIAA/ASME/SAE/ASEE Joint Propulsion Conference, Huntsville, AL 2000. Paper 2000-3647.

Ostrowski et al., "Recent Accomplishments in MIC Primer Development at NSWC/Indian Head," Paper 2005-3514, AIAA 41st Joint Propulsion Conference, Tucson, AZ 2005.

Ostrowski et al., "Nano Energetics for US Navy Percussion Primer Applications", Energetic Materials Technology. pp. 1-6.

Stevenson et al., Frankford Arsenal Report No. R-265; Caliber .30 Red Phosphorus Primers, Third Report Research Item No. 204.0, Frankfort Arsenal Library, Feb. 1943.

Nordblom et al., Frankford Arsenal Report No. R-206; The Stabilization of Commerical Red Phosphorus Final Report, Research Item No. 202.14, Frankford Arsenal Library. Apr. 1943.

United States Army, Small Caliber Ammunition Test Procedures 5.56 mm Cartridges, Picatinny Arsenal, New Jersey, Nov. 1998. pp. 1-191.

Eisentrager, Frank, "Key Parameters for the Stability of Red Phosphorous", 31st International Pyrotechnic Seminar Proceedings, Jul. 2004. Colorado Springs, Colorado. Copyright 2000 IPSUSA.

Ratcliff, Andrew, "Review of Six Generations of Red Phosphorous 1950-1999 and Beyond", 27th International Pyrotechnic Seminar Proceedings, Jul. 2000. Grand Junction Colorado. Copyright 2000. IPSUSA.

Horoeld et al, "Commerical Developments in Red Phosphorous Performance and Stability for Pyrotechnics", Journal of Pyrotechnics, Issue 12. Summer 2001. Copyright 2001. IPS.

Collins et al., "The Use of Red Phosphorous in Pyrotechnics—Results of an International Investigation". 31st International Pyrotechnics Seminar Proceedings. Jul. 2004. Colorado Springs, Colorado. Copyright 2002. IPSUSA.

European Search Report for European Application No. EP07004155 dated Jul. 16, 2007.

Alenfelt, "Corrosion protection of magnesium without the use of chromates", Pyrotechnica XVI (Aug. 1995), pp. 44-49. Pyrotechnia Publications, Austin, Texas.

Muller, "Citric acid as corrosion inhibitor for aluminium pigment", Corrosion Science, vol. 46, No. 1. Jan. 2004. pp. 159-167.
Application and File History for U.S. Appl. No. 12/029,084, filed Feb. 11, 2008, inventor Erickson.
Application and File History for U.S. Appl. No. 11/704,530, filed Feb. 9, 2007, inventor Erickson.
Application and File History for U.S. Appl. No. 12/559,218, filed Sep. 14, 2009, inventor Johnston.
Application and File History for U.S. Appl. No. 11/093,633, filed Mar. 30, 2005, inventor Johnston.
International Search Report and Written Opinion of International Application No. PCT/US2008/068275 date of mailing Jan. 13, 2009.
International Search Report and Written Opinion of International Application No. PCT/US2007/003806 date of mailing Jan. 13, 2009.
European Office Action of European Application No. 07870653.8 dated Feb. 21, 2011.
Canadian Office Action of Canadian Application No. 2668123 dated Aug. 15, 2011.

* cited by examiner

NON-TOXIC, HEAVY-METAL FREE SENSITIZED EXPLOSIVE PERCUSSION PRIMERS AND METHODS OF PREPARING THE SAME

FIELD OF THE INVENTION

The present invention relates to non-hydroscopic, non-toxic, heavy-metal free percussion primer compositions for explosive systems, and to methods of making the same.

BACKGROUND OF THE INVENTION

Conventional percussion primer mixes of almost all calibers of small arms ammunition traditionally utilized, for the most part, a combination of lead styphnate as the initiating explosive, antimony sulfide as the fuel, and barium nitrate as the oxidizer in various ratios. Besides these lead, antimony and barium containing compounds, various other compounds containing objectionable chemicals such as mercury, potassium chlorate, and like have also been used in percussion primers in various ratios. Due to the toxicity, ecological impact, corrosiveness, and/or expensive handling procedures during both production and disposal of such objectionable chemicals, there has been an effort to replace compounds containing such objectionable chemicals in percussion primers.

The Department of Defense (DOD) and the Department of Energy (DOE) have made a significant effort to find replacements for toxic metal based percussion primers. Furthermore, firing ranges and other locales of firearms usage have severely limited the use of percussion primers containing toxic metal compounds due to the potential health and handling risks associated with the use of lead, barium and antimony.

Ignition devices have traditionally relied on the sensitivity of the primary explosive, which significantly limits available primary explosives. The most common alternative to lead styphnate is diazodinitrophenol (DDNP). DDNP-based primers, however, do not fully meet commercial or military reliability and have been for several decades relegated to training ammunition, as such primers suffer from poor reliability that may be attributed to low friction sensitivity, low flame temperature, and are hygroscopic. The ability of a percussion primer to function reliably at low temperatures becomes particularly important when percussion primed ammunition is used in severe cold, such as in aircraft gun systems that are routinely exposed to severe cold.

Another potential substitute for lead styphnate that has been identified is metastable interstitial composites (MIC) (also known as metastable nanoenergetic composites (MNC), nano-thermites or superthermites), which includes Al—$MoO_3$, Al—$WO_3$, Al—CuO and Al—$Bi_2 2O_3$. In these composites, both the aluminum powder and oxidizing material have a particle size of less than 0.1 micron and more preferably between 20-50 nanometers. The thermite interaction between the fuel and oxidizer resulting from high surface area and minimal oxide layer on the fuel has resulted in excellent performance characteristics, such as impact sensitivity, high temperature output, and reliability under stated conditions (−65° F. to +160° F.). However, it has been found that these systems, despite their excellent performance characteristics, are difficult to process safely and cost-effectively on a large-scale. The main difficulty is handling of nano-size powder mixtures due to their sensitivity to friction and electrostatic discharge (ESD), and their reactivity in air. See U.S. Pat. No. 5,717,159 and U.S. Patent Publication No. 2006/0113014. As a result, much technology has been devoted to the safe and cost-effective handling of these nano-sized materials.

Still another potential substitute for lead styphnate that has been identified are compounds that contain moderately insensitive explosives that are sensitized by nano-sized fuel particles. The explosive in such compounds is moderately insensitive to shock, friction and heat according to industry standards and has been categorized generally as a secondary explosive due to their relative insensitivity. Examples of such energetics include CL-20, PETN, RDX, HMX, nitrocellulose and mixtures thereof. The nano-sized fuel particles have an average particle size less than about 1500 nanometers and most suitably less than 650 nanometers, which may include aluminum, boron, molybdenum, silicon, titanium, tungsten, magnesium, melamine, zirconium, calcium silicide or mixtures thereof. See, for example, U.S. Patent Publication No. 2006/0219341 and U.S. Patent Publication No. 2008/0245252. However, safety and cost-efficiency concerns still remain due to the nano-size fuel particles, despite such compounds exhibiting excellent performance characteristics.

In light of the foregoing identified problems, there remains a need in the art for a percussion primer that is free of toxic metals, is non-corrosive and non-erosive, may be processed and handled safely and economically, has superior sensitivity and ignition performance characteristics compared to traditional primer mixes, contains non-hydroscopic properties, is stable over a broad range of storage conditions and temperatures, and is cheaper to produce than conventional heavy metal primer mixes.

BRIEF SUMMARY OF THE INVENTION

In one aspect, the present invention relates to a primer composition including at least one moderately insensitive explosive that is a member selected from the group consisting of nitrocellulose, pentaerythritoltetranitrate (PETN), CL-20, RDX, HMX, TNT, nitroguanidine, styphnic acid, potassium dinitrobenzofuroxan (KDNBF), and mixtures thereof, and at least one fuel particle having an average particle size of about 1.5 microns to about 12 microns.

In another aspect, the present invention relates to a primer composition wherein at least one moderately insensitive explosive and micron-size fuel particle provide a fuel-explosive system wherein traditional primary explosives, such as lead styphnate and diazodinitrophenol (DDNP), are absent from the primer composition.

In another aspect, the present invention relates to a primer composition including a moderately insensitive secondary explosive; at least one fuel particle having an average particle size of about 1.5 microns to about 12 microns, and a moderately active metal oxidizer selected from the group consisting of bismuth trioxide, bismuth subnitrate, bismuth tetroxide, bismuth sulfide, zinc peroxide, tin oxide, manganese dioxide, molybdenum trioxide, and combinations thereof.

In another aspect, the present invention relates to a slurry of particulate components in an aqueous media, the particulate components including three different particulate components, the particulate components being particulate moderately insensitive explosive that is a member selected from the group consisting of nitrocellulose, pentaerythritoltetranitrate (PETN), CL-20, RDX, HMX, TNT, nitroguanidine, styphnic acid, potassium dinitrobenzofuroxan (KDNBF), and mixtures thereof, a particulate fuel particle having an average size of between about 1.5 microns and 12 microns, and oxidizer particles.

In another aspect, the present invention relates to a primer composition substantially devoid of a traditional primary explosive, but instead containing a composite explosive comprising a moderately insensitive explosive that is a member selected from the group consisting of nitrocellulose, pentaerythritoltetranitrate (PETN), CL-20, RDX, HMX, TNT, nitroguanidine, styphnic acid, potassium dinitrobenzofuroxan (KDNBF), and mixtures thereof, and at least one fuel particle component having a size of between about 1.5 microns and 12 microns, wherein the amount of the moderately insensitive explosive and at least one fuel particle component is about primer premixture is at least 11 wt-% based on the dry weight of the percussion primer composition.

In another aspect, the present invention relates to a percussion primer including at least one fuel particle component substantially devoid of any particles having a particle size of about 1000 nanometers or less.

In another aspect, the present invention relates to a primer-containing ordnance assembly including a housing including at least one percussion primer according to any of the above embodiments.

In another aspect, the present invention relates to a method of making a percussion primer or igniter, the method including providing at least one water wet explosive selected from the group consisting of nitrocellulose, pentaerythritoltetranitrate (PETN), CL-20, RDX, HMX, TNT, nitroguanidine, styphnic acid, potassium dinitrobenzofuroxan (KDNBF), and mixtures thereof, combining at least one fuel particle having an average particle size between about 1.5 microns and about 12 microns with the at least one water wet explosive to form a first mixture, and combining at least one oxidizer with the first mixture.

In another aspect, the present invention relates to a method of making a percussion primer, the method including providing at least one water wet explosive selected from the group consisting of nitrocellulose, pentaerythritoltetranitrate (PETN), CL-20, RDX, HMX, TNT, nitroguanidine, styphnic acid, potassium dinitrobenzofuroxan (KDNBF), and mixtures thereof, combining a plurality of fuel particles having a particle size range of about 1.5 microns to about 12 microns with the at least one water wet explosive to form a first mixture, and combining at least one oxidizer with the first mixture.

In another aspect, the present invention relates to a method of making a percussion primer including providing at least one wet explosive selected from the group consisting of nitrocellulose, pentaerythritoltetranitrate (PETN), CL-20, RDX, HMX, TNT, nitroguanidine, styphnic acid, potassium dinitrobenzofuroxan (KDNBF), and mixtures thereof, combining at least one fuel particle having an average particle size of about 1.5 microns to about 12 microns with the at least one water wet explosive to form a first mixture, and combining at least one oxidizer having an average particle size of about 1 micron to about 200 microns with the first mixture.

In another aspect, the present invention relates to a method of making a primer composition including providing at least one water wet explosive selected from the group consisting of nitrocellulose, pentaerythritoltetranitrate (PETN), CL-20, RDX, HMX, TNT, nitroguanidine, styphnic acid, potassium dinitrobenzofuroxan (KDNBF), and mixtures thereof, combining a plurality of fuel particles having an average particle size of about 1.5 microns to about 12 microns with the at least one water wet explosive, and combining an oxidizer having an average particle size of about 1 micron to about 200 microns with the first mixture.

In any of the above embodiments, the oxidizer may be combined with the explosive, with the first mixture, or with the fuel particle component.

These and other aspects of the invention are described in the following detailed description of the invention or in the claims.

BRIEF DESCRIPTION OF THE DRAWINGS

The invention may be more completely understood in consideration of the following detailed description of various embodiments of the invention in connection with the accompanying drawings, in which.

Figure 1A:
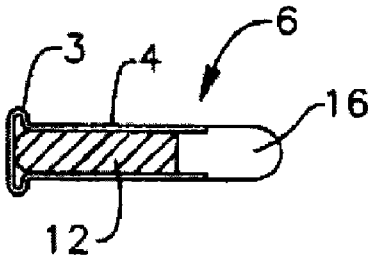
FIG. 1A is a longitudinal cross-section of a rimfire gun cartridge employing a percussion primer composition of one embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

In one aspect, instead of containing a traditional primary explosive, the primer compositions of the present invention contain a composite explosive that comprises at least one moderately insensitive explosive and at least one fuel agent having a particle size between about 1.5 microns and 12 microns. The explosive in such compounds is moderately insensitive to shock, friction and heat according to industry standards and has been categorized generally as a secondary explosive due to their relative insensitivity. Examples of such energetics include CL-20, PETN, RDX, HMX, KDNBF, nitrocellulose, and mixtures thereof. Examples of fuel agents for use with the energetic to form the composite explosive include, but are not limited to, aluminum, boron, molybdenum, titanium, tungsten, magnesium, melamine, zirconium, calcium silicide, and mixtures thereof.

The sensitivity of the composite explosive is created by the interaction between the moderately insensitive explosive and the fuel agent. The primer compositions of the present invention are capable of performing the same function and meeting or exceeding the performance characteristics of common primer compositions containing traditional heavy metal bearing primary explosives, such as lead styphnate, or other traditional primary explosives such as DDNP. This new explosive system also addresses the oxidizer replacement problem experienced in primer formulations devoid of metallic oxidizers (such as barium nitrate) by creating sufficient heat to utilize less active, non-toxic oxidizers. Not only may traditional primary explosives and oxidizers that are objectionable be eliminated in the primer compositions of the present invention, but nano-sized fuel components are substantially absent from the primer compositions of the present invention, which also eliminates the safety and cost-efficiency drawbacks related thereto. As a result, the primer compositions of the present invention are completely non-toxic, non-hydroscopic, more cost-effective, and much more safe to produce.

In one aspect, the present invention relates to percussion primer compositions that comprises at least one composite explosive, which contains at least one moderately insensitive explosive component and at least one fuel agent having a particle size of about 1.5 microns to about 12 microns, suitably about 2 microns to about 9 microns and more suitably about 3 microns to about 6 microns, and at least one oxidizer.

In some embodiments, other components may be added to the primer compositions comprising at least one composite explosive and at least one oxidizer, such as a sensitizer for increasing the sensitivity of the explosive component, a binder, ground propellant, additional fuel agents and/or additional explosive components.

Examples of suitable classes of explosives include, but are not limited to, nitrate esters, nitramines, nitroaromatics and mixtures thereof. Explosives may be categorized into primary explosives and secondary explosives depending on their relative sensitivity and common use within the industry, with the secondary explosives being less sensitive than the primary explosives. Secondary explosives may also be referred to as moderately insensitive explosives. Suitably, the explosive employed in the percussion primer compositions of the present invention includes at least one moderately insensitive explosive that is typically referred to as a secondary explosive within the industry.

Examples of nitrate esters include, but are not limited to, PETN (pentaerythritoltetranitrate) and nitrocellulose. Nitrocellulose includes nitrocellulose ball powder and nitrocellulose fiber having a high percentage of nitrogen, for example, between about 10 wt-% and 13.6 wt-% nitrogen.

Examples of nitramines include, but are not limited to, CL-20, RDX, HMX and nitroguanidine. CL-20 is 2,4,6,8,10,12-hexanitrohexaazaisowurtzitane (HNIW) or 2,4,6,8,10,12-hexanitro-2,4,6,8,10,12-hexaazatetracyclo[5.5.0.0.$^{5,9}$0$^{3,11}$]-dodecane. RDX (royal demolition explosive), hexahydro-1,3,5-trinitro-1,3,5 triazine or 1,3,5-trinitro-1,3,5-triazacyclohexane, may also be referred to as cyclonite, hexagen, or cyclotrimethylenetrinitramine. HMX (high melting explosive), octahydro-1,3,5,7-tetranitro-1,3,5,7-tetrazocine or 1,3,5,7-tetranitro-1,3,5,7 tetra azacyclooctane (HMX), may also be referred to as cyclotetramethylene-tetranitramine or octagen, among other names.

Examples of nitroaromatics include, but are not limited to, tetryl (2,4,6-trinitrophenyl-methylnitramine), TNT (2,4,6-trinitrotoluene), TNR (2,4,6-trinitroresorcinol or styphnic acid), and DDNP (diazodinitrophenol or dinol or 4,6-dinitrobenzene-2-diazo-1-oxide).

Examples of primary explosives include, but are not limited to, lead styphnate, metal azides, mercury fulminate, and DDNP. As noted above, such primary explosives are undesirable for use as the primary explosive in the percussion primer compositions of the present invention. In some embodiments, there is substantially no traditional primary explosive component present in the percussion primer compositions of the present invention.

The explosive employed in the composite explosive of the percussion primer compositions includes explosives traditionally identified as a secondary explosive. Preferred moderately insensitive explosives according to the present invention include, but are not limited to, nitrocellulose, pentaerythritoltetranitrate (PETN), CL-20, RDX, HMX, TNT, nitroguanidine, styphnic acid, alkali metal and/or alkaline earth metal salts of dinitrobenzofuroxanes such as potassium dinitrobenzofuroxan (KDNBF), and mixtures thereof. The quantities of moderately insensitive explosives in the composite explosive of the primer compositions according to the present invention can be between about 5 and 40 wt. % for example, based on the total primer composition, more suitably between 8 and 20 wt. %. The quantity of moderately insensitive explosives may be varied depending on the moderately insensitive explosive or combination of moderately insensitive explosives employed.

In some embodiments, nitrocellulose is employed as a moderately insensitive explosive in the composite explosive. Nitrocellulose, particularly nitrocellulose fibers having a high percentage of nitrogen, for example, greater than about 10 wt-% nitrogen, and having a high surface area, has been found to increase sensitivity. In primer compositions wherein the composition includes nitrocellulose fibers in the composite explosive, flame temperatures exceeding those of lead styphnate have been created. In some embodiments, the nitrocellulose fibers have a nitrogen content of about 12.5 wt-% to about 13.6 wt-%.

The moderately insensitive explosives can be of varied particulate size. For example, particle size may range from approximately 0.1 micron to about 100 microns. The combination or blending of more than one size and type can be effectively used to adjust the primer composition sensitivity.

Examples of suitable fuel particles for use with the energetic to form the composite herein include, but are not limited to, aluminum, boron, molybdenum, titanium, tungsten, magnesium, melamine, zirconium, calcium silicide, and mixtures thereof.

The fuel particle may have an average particle size between about 1.5 microns and 12 microns, more suitably between about 2 microns and 9 microns, and most suitably between about 3 microns and 6 microns. In some embodiments a plurality of particles having a size distribution is employed. The distribution of the fuel particles may between about 1.5 microns and 12 microns, more suitably between about 2 microns and 9 microns, and most suitably between about 3 microns and 6 microns. The distribution may be unimodal or multimodal. Suitably the fuel particle generally has a spherical shape, although other shapes such as platelets may be utilized.

It is surmised that the sensitivity of the resulting composite explosive resulting from the moderately insensitive explosive and the micron-sized fuel particle is a product of the resulting surface area between these components. Accordingly, it has been observed that the quantities of the one or more fuel particle components in the composite explosive of the primer compositions according to the present invention may be dependent upon this surface area relationship such that less amounts are needed for smaller particle sizes. For example, the quantity of the fuel particle component may be less for 2 micron-size particles than 6 micron-size particles, as larger particle sizes have less respective contact surface area with the moderately insensitive explosive component. Suitably, in particular embodiments, the micron sized fuel particles are employed in the primer composition, on a dry weight basis, in an amount of between about 5 and 25 wt-% for example, based on the total primer composition, more suitably between about 6 and 12 wt-%, and most suitably between about 9 and 10 wt-%. It is desirable to have at least about 5 wt-%, more suitably at least about 7 wt-%, and most suitably at least about 9 wt-% of the micron-size fuel particles, based on the dry weight of the primer composition.

In one particular embodiment, the fuel particles have an average fuel particle size of about 3 microns and are present in the amount of about 9 wt-%. As one specific example, spherical aluminum fuel particles having an average particle size of about 3 microns in the amount of 9 wt-% may be selected as the fuel agent in the composite explosive of the primer compositions of the present invention.

As noted above, nano-size fuel particles (1500 nm in size or less) are undesirable for use in the percussion primer compositions of the present invention. In some embodiments, there is substantially no nano-size fuel particles present in the percussion primer compositions of the present invention.

One specific example of a fuel particle that may be employed herein is Valimet™ spherical micron-sized aluminum powder having an average particle size of about 2 microns to about 12 microns.

An oxidizer is suitably employed in the primer compositions according to one or more embodiments of the invention. Oxidizers may be employed in the primer composition, on a dry weight basis, in an amount of between about 35 wt-% to about 80 wt-% of the primer composition, more suitably between about 50 wt-% to about 70 wt-%, and most suitably between about 60 wt-% and 67 wt-% of the dry primer composition. Suitably, the oxidizers employed herein are moderately active metal oxides, non-hygroscopic, and are not considered toxic such that they make a moderately dense and reliable primer composition when combined with the composite explosive. Examples of such oxidizers include, but are not limited to, bismuth trioxide, bismuth subnitrate, bismuth tetroxide, bismuth sulfide, zinc peroxide, tin oxide, manganese dioxide, molybdenum trioxide, potassium nitrate, and combinations thereof.

The oxidizer is not limited to any particular particle size. However, it may be more desirable that the oxidizer has an average particle size that is about 1 micron to about 200 microns, more suitably about 10 microns to about 200 microns, and most suitably about 100 microns to about 200 microns. In a particular embodiment, the oxidizer employed is bismuth trioxide having an average particle size of about 100 to about 200 microns, for example, about 177 microns, may be employed.

A sensitizer may be added to the percussion primer compositions according to one or more embodiments of the invention. As the particle size of the micron-size fuel particles increases, sensitivity decreases. Thus, like its use in traditional lead styphnate formulations, a sensitizer may be beneficial for improved uniformity of ignition. However, a sensitizer is not required for sensitizing the primer compositions of the present invention. Sensitizers may be employed in amounts of 0 wt-% to about 10 wt-%, suitably 0 wt-% to about 8 wt-% by weight, and more suitably 0 wt-% to about 4 wt-% of the primer composition. One example of a suitable sensitizer includes, but is not limited to, tetracene.

The sensitizer may be employed in combination with a friction agent. A friction agent may also be employed in the primer compositions of the present invention in the absence of a sensitizer. A friction agent may also have sensitizing characteristics. Friction agents may be employed in rimfire applications in amounts of about 0 wt-% to about 25 wt-% of the primer composition. Examples of a suitable friction agent include, but are not limited to, glass powder, glass balls, calcium silicide, boron, and mixtures thereof.

One or more propellant component may be added to the percussion primer compositions in amounts of 0 wt-% to about 20 wt-%, suitably 0 wt-% to about 10 wt-% by weight, and more suitably 0 wt-% to about 6 wt-% of the primer composition. Examples of a suitable propellant component include, but are not limited to, single-base or double-base ground fines, such as Hercules fines.

Other conventional primer additives such as binders may be employed in the primer compositions herein as is known in the art. Both natural and synthetic binders find utility herein. Examples of suitable binders include, but are not limited to, natural and synthetic gums including xanthan, Arabic, tragacanth, guar, karaya, and synthetic polymeric binders such as hydroxypropylcellulose and polypropylene oxide, as well as mixtures thereof. Binders may be added in amounts of about 0 wt-% to about 5 wt-% of the composition, suitably about 0 wt-% to about 1.5 wt % of the composition, and more suitably about 0 wt-% to about 1 wt-%.

Other optional ingredients as are known in the art may also be employed in the compositions according to one or more embodiments of the invention. For example, inert fillers, diluents, other binders, low output explosives, etc., may be optionally added.

Buffers may optionally be added to the primer compositions to decrease the likelihood of hydrolysis of the fuel particles and as a stabilizer, which is dependent on both temperature and pH. See U.S. Patent Publication No. 2008/0245252 A1, the entire content of which is incorporated by reference herein. Such buffers may also include styphnic acid.

The above lists and ranges are intended for illustrative purposes only, and are not intended as a limitation on the scope of the present invention.

In one preferred embodiment, the composite explosive of the primer compositions of the present invention comprises a moderately insensitive explosive, such as nitrocellulose fiber, employed in combination with an aluminum particulate fuel having an average particle size of between about 1.5 microns and 12 microns, more suitably between about 2 microns and 9 microns, and most suitably between about 3 microns and 6 microns. A preferred oxidizer is bismuth trioxide having an average particle size between about 1 micron and 200 microns, for example about 100 microns to about 200 microns is employed.

The primer compositions according to one or more embodiments of the invention may be processed using simple water processing techniques. The present invention allows the use of moderately insensitive explosive components that are water wet while the micron-size fuel particles and oxidizer component are added as dry components, which are safer for handling while maintaining the sensitivity of the assembled primer. It is surmised that this may be attributed to the use of larger fuel particles. The steps of milling and sieving, which may be employed for MIC-MNC formulations are also eliminated. For at least these reasons, processing of the primer compositions according to the invention is safer and more cost-efficient.

The method of making the primer compositions according to one or more embodiments of the invention generally includes mixing the moderately insensitive explosive wet with at least one fuel particle component having a particle size of between about 1.5 and 12 microns to form a first mixture. A dry oxidizer may be added to the first mixture, with the wet explosive before the at least one fuel particle component, or with the wet explosive in combination with or simultaneously with the at least one fuel particle component. When the oxidizer is added in combination with the at least one fuel particle component, the oxidizer and the at least fuel particle component may be dry mixed. The oxidizer may be optionally dry blended with at least one other component, such as a binder, sensitizer, and/or propellant to form a second dry mixture, and the second mixture then added to the first mixture and mixing until homogeneous to form a final mixture.

The method of making the primer compositions according to one or more embodiments of the invention generally includes precipitating the moderately insensitive explosive onto the at least one fuel particle component having a particle size of between about 1.5 and 12 microns to form a first homogenous mixture. After the homogenous mixture of the moderately insensitive explosive precipitated onto the at least one fuel particle component is provided, the other components of the primer composition, are added and mixed.

The primer compositions according to one or more embodiments of the invention do not require additional solvents, although the invention is not limited as such.

As used herein, the term water-wet, shall refer to a water content of between about 10 wt-% and about 50 wt-%, more suitably about 15 wt-% to about 40 wt-% and even more suitably about 20 wt-% to about 30 wt-%. In one embodiment, about 25 wt-% water or more is employed, for example, 28 wt-% is employed.

If a sensitizer is added, the sensitizer may be added either to the water wet moderately insensitive explosive, or to the moderately insensitive explosive/fuel particle wet blend. The sensitizer may optionally further include a friction generator such as glass powder.

Although several mechanisms can be employed depending on the explosive component, it is clear that simple water mixing methods may be used to assemble the percussion primer compositions of the present invention using standard industry practices and such assembly can be accomplished safely without stability issues. The use of such water processing techniques is beneficial as previous primer compositions such as MIC/MNC primer compositions have limited stability in water.

The combination of ingredients employed in the percussion primer compositions of the present invention is beneficial because it allows for a simplified processing sequence in which the micron-fuel particles and oxidizer do not need to be premixed. The larger oxidizer particles employed, along with the use of a moderately insensitive secondary explosive, therefore allows a process that is simpler, has an improved safety margin and at the same time reduces material and handling cost. Thus the invention provides a commercially efficacious percussion primer, a result that has heretofore not been achieved.

Broadly, the composite explosive (moderately insensitive explosive with micron-sized fuel particle components) according to one or more embodiments of the invention, can be substituted in applications where traditional lead styphnate and diazodinitrophenol (DDNP) primers and igniter formulations are employed. The composite explosive of the present invention alone is a good ignitor like lead styphnate, where DDNP is lacking. The heat output of the composite explosive of the present invention is sufficient to utilize non-toxic metal oxidizers of higher activation energy typically employed but under utilized in lower flame temperature DDNP-based formulations.

Additional benefits of the present invention include improved stability, increased ignition capability, improved ignition reliability, lower cost, and increased safety due to the elimination of production and handling concerning undesirable components, such as lead styphnate and nano-sized fuel agents.

The present invention finds utility in any igniter or percussion primer application where lead styphnate is currently employed. For example, the percussion primer according to the present invention may be employed for small caliber and medium caliber cartridges, as well as industrial powerloads, airbags, and the like.

The following tables provide various compositions and concentration ranges for a variety of different cartridges. Such compositions and concentration ranges are for illustrative purposes only, and are not intended as a limitation on the scope of the present invention.

For purposes of the following tables, the nitrocellulose component comprises nitrocellulose fiber at 13.6 wt-% nitrogen. The fuel particle component is spherical micron-size aluminum sold under the trade name of Valimet™, which has a normal distribution with the average particles size between 2 and 3 microns as identified in each respective table.

TABLE 1

Illustrative percussion primer compositions for pistol

| Composition Component | Suitable Range wt-% | More Suitable Range wt-% |
|---|---|---|
| Nitrocellulose | 5-25 | 10-20 |
| Aluminum (2 micron) | 5-25 | 6-12 |
| Tetracene | 0-10 | 0-4 |
| Ground Propellant | 0-20 | 0-10 |
| Bismuth Trioxide | 40-80 | 50-70 |
| Gum Tragacanth | 0-5 | 0-1 |

TABLE 2

Illustrative percussion primer compositions for rifle

| Composition Component | Suitable Range wt-% | More Suitable Range wt-% |
|---|---|---|
| Nitrocellulose | 5-25 | 10-20 |
| Aluminum (3 micron) | 5-25 | 6-12 |
| Tetracene | 0-10 | 0-4 |
| Ground Propellant | 0-20 | 0-10 |
| Bismuth Trioxide | 40-80 | 50-70 |
| Gum Tragacanth | 0-5 | 0-1 |

TABLE 3

Illustrative percussion primer compositions rifle

| Composition Component | Suitable Range wt-% | More Suitable Range wt-% |
|---|---|---|
| Nitrocellulose | 5-25 | 10-20 |
| Aluminum (2 micron) | 5-25 | 6-12 |
| Tetracene | 0-10 | 0-4 |
| PETN | 0-25 | 0-10 |
| Ground Propellant | 0-20 | 0-10 |
| Bismuth Trioxide | 40-80 | 50-70 |
| Gum Tragacanth | 0-5 | 0-1 |

TABLE 4

Illustrative percussion primer compositions for rifle

| Composition Component | Suitable Range wt-% | More Suitable Range wt-% |
|---|---|---|
| Nitrocellulose | 5-25 | 10-20 |
| Aluminum (3 micron) | 5-25 | 6-12 |
| Tetracene | 0-10 | 0-4 |

TABLE 4-continued

| Illustrative percussion primer compositions for rifle | | |
|---|---|---|
| Composition Component | Suitable Range wt-% | More Suitable Range wt-% |
| Ground Propellant | 0-20 | 0-10 |
| Bismuth Subnitrate | 35-80 | 55-75 |
| Gum Tragacanth | 0-5 | 0-1 |

TABLE 5

| Illustrative percussion primer compositions for shotshell | | |
|---|---|---|
| Composition Component | Suitable Range wt-% | More Suitable Range wt-% |
| Nitrocellulose | 5-25 | 10-20 |
| Aluminum (2 micron) | 5-25 | 6-12 |
| Tetracene | 0-10 | 0-4 |
| PETN | 0-25 | 0-10 |
| Ground Propellant | 0-20 | 0-10 |
| Bismuth Trioxide | 40-80 | 50-70 |
| Gum Tragacanth | 0-5 | 0-1 |

TABLE 6

| Illustrative percussion primer compositions for rifle | | |
|---|---|---|
| Composition Component | Suitable Range wt-% | More Suitable Range wt-% |
| Nitrocellulose | 5-25 | 10-20 |
| Aluminum (3 micron) | 5-25 | 6-12 |
| Tetracene | 0-10 | 0-4 |
| PETN | 0-25 | 0-10 |
| Ground Propellant | 0-20 | 0-10 |
| Bismuth Subnitrate | 35-80 | 55-75 |
| Gum Tragacanth | 0-5 | 0-1 |

TABLE 7

| Illustrative percussion primer compositions for rimfire | | |
|---|---|---|
| Composition Component | Suitable Range wt-% | More Suitable Range wt-% |
| Nitrocellulose | 5-25 | 6-20 |
| Aluminum (3 micron) | 5-25 | 6-12 |
| Tetracene | 0-10 | 0-4 |
| KDNBF | 0-35 | 0-35 |
| Bismuth Subnitrate | 35-80 | 55-75 |
| Borosilicate Glass | 0-25 | 0-15 |
| Gum Tragacanth | 0-5 | 0-1 |

In one embodiment, the percussion primer is used in a centerfire gun cartridge, a rimfire gun cartridge, or a shotshell. In small arms using the rimfire gun cartridge, a firing pin strikes a rim of a casing of the gun cartridge. In contrast, the firing pin of small arms using the centerfire gun cartridge strikes a metal cup in the center of the cartridge casing containing the percussion primer. Gun cartridges and cartridge casings are known in the art and, therefore, are not discussed in detail herein. The force or impact of the firing pin may produce a percussive event that is sufficient to initiate the percussion primer.

Figure 1B:
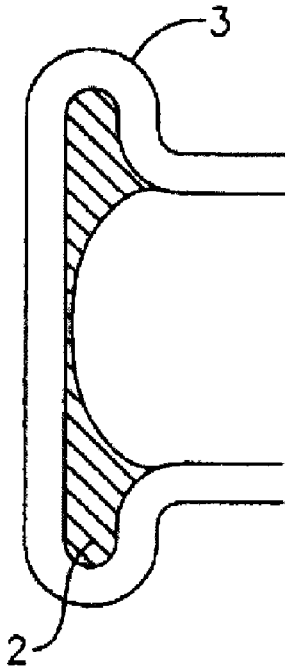
FIG. 1B is an enlarged view of the anterior portion of the rimfire gun cartridge shown in FIG. 1A.

Turning now to the figures, FIG. 1A is a longitudinal cross-section of a rimfire gun cartridge shown generally at 6. Cartridge 6 includes a housing 4. Percussion primer composition 2 may be substantially evenly distributed around an interior volume defined by a rim portion 3 of casing 4 of the cartridge 6 as shown in FIG. 1B which is an enlarged view of an anterior portion of the rimfire gun cartridge 6 shown in FIG. 1A.

Figure 2A:
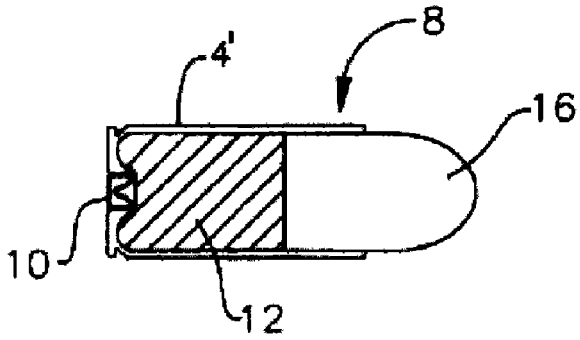
FIG. 2A a longitudinal cross-section of a centerfire gun cartridge employing a centerfire percussion primer of one embodiment of the invention.
Figure 2B:
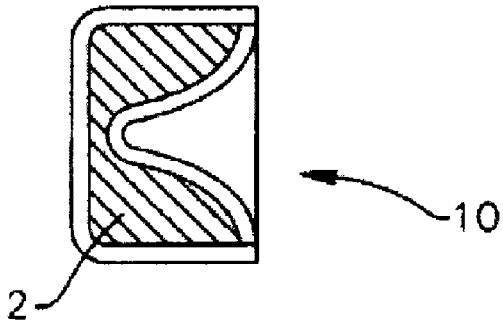
FIG. 2B is an enlarged view of the centerfire percussion primer of FIG. 2A.

FIG. 2A is a longitudinal cross-sectional view of a centerfire gun cartridge shown generally at 8. As is common with centerfire gun cartridges, FIG. 2A illustrates the centerfire percussion primer assembly 10 in an aperture of the casing 4'. FIG. 2B is an enlarged view of the center fire percussion primer assembly 10 more clearly showing the percussion primer composition in the percussion primer assembly 10. Centerfire gun cartridges are known in the art and, therefore, are not discussed in detail herein.

The propellant composition 12 may be positioned substantially adjacent to the percussion primer composition 2 in the rimfire gun cartridge 6. In the centerfire gun cartridge 8, the propellant composition 12 may be positioned substantially adjacent to the percussion primer assembly 10. When ignited or combusted, the percussion primer composition 2 may produce sufficient heat and combustion of hot particles to ignite the propellant composition 12 to propel projectile 16 from the barrel of the firearm or larger caliber ordnance (such as, without limitation, handgun, rifle, automatic rifle, machine gun, any small and medium caliber cartridge, automatic cannon, etc.) in which the cartridge 6 or 8 is disposed. The combustion products of the percussion primer composition 2 are environmentally friendly, non-toxic, non-corrosive, and non-erosive.

Figure 3:
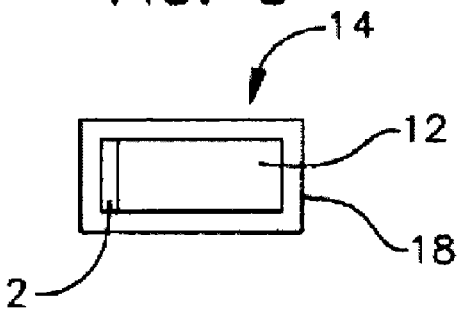
FIG. 3 is a schematic illustration of exemplary ordnance in which a percussion primer of one embodiment of the invention is used.

As previously mentioned, the percussion primer composition 2 may also be used in larger ordnance, such as (without limitation) grenades, mortars, or detcord initiators, or to initiate mortar rounds, rocket motors, or other systems including a secondary explosive, alone or in combination with a propellant, all of the foregoing assemblies being encompassed by the term "primer-containing ordnance assembly," for the sake of convenience. In the ordnance, motor or system 14, the percussion primer combustion 2 may be positioned substantially adjacent to a secondary explosive composition 12 in a housing 18, as shown in FIG. 3. For purposes of simplicity, as used herein, the term "ordnance" shall be employed to refer to any of the above-mentioned cartridges, grenades, mortars, initiators, rocket motors, or any other systems in which the percussion primer disclosed herein may be employed.

In any of the cartridge assemblies discussed above, the wet primer composition is mixed in a standard mixer assembly such as a Hobart or planetary type mixer. Primer cups are charged as a wet primer mixture into the cup. An anvil is seated into the charged cup, and the assembly is then placed in an oven to dry.

In Table 8 below, non-limiting examples are further provided to illustrate the present invention, but are in no way intended to limit the scope thereof. The letters P, SR, LR, R, and SS with respect to each non-limiting example denotes different types of ammunition ("P" refers to pistol cartridges, "SR" refers to small rifle cartridges, "LR" refers to large rifle cartridges, "R" refers to rimfire cartridges, and "SS" refers to shotshells). Each of the components provided are present in weight percentage, and characteristics of the nitrocellulose component and the aluminum fuel particle component are the same as provided in the tables above.

TABLE 8

Example Percussion Primer Compositions

| Component | Ex. 1 (P) | Ex. 2 (SR) | Ex. 3 (LR) | Ex. 4 (SR) | Ex. 5 (SS) | Ex. 6 (SR) | Ex. 7 (R) |
|---|---|---|---|---|---|---|---|
| Nitrocellulose | 18 | 15 | 15 | 15 | 15 | 15 | 6 |
| Aluminum (2 μm) | 9 | — | — | — | 9 | — | — |
| Aluminum (3 μm) | — | 9 | 9 | 9 | — | 9 | 5 |
| Tetracene | 4 | 4 | 2 | 4 | 6 | 4 | 4 |
| KDNBF | — | — | — | — | — | — | 32 |
| PETN | — | — | — | — | 5 | 5 | — |
| Ground Propellant | 3 | 6 | 6 | 6 | 6 | 6 | — |
| Bismuth Trioxide | 65 | 65 | 67 | — | 60 | — | — |
| Bismuth Subnitrate | — | — | — | 65 | — | 60 | 37 |
| Borosilicate Glass | — | — | — | — | — | — | 15 |
| Gum Tragacanth | 1 | 1 | 1 | 1 | 1 | 1 | 1 |

An example of making the primer compositions of Examples 1-7 generally includes:

(a) mixing the nitrocellulose component wet with the aluminum fuel particle component to form the composite explosive;

(b) adding the remaining wet-energetic components to the composite explosive and mixing. The remaining wet-energetic components may include tetracene, ground propellant, KDNBF, PETN, and mixtures thereof.

(c) adding the dry blend components to the composition in (b) and mixing until homogeneous to form the primer compositions of the present invention. The dry blend components may include the oxidizer, frictionator, and binder component.

Water may also be added in any of the foregoing steps to adjust the moisture content of the composition mix. In some embodiments, water is added before the dry components are added to adjust the moisture content before the components are mixed. In some other embodiments, water is added after the dry components are added. Primer compositions of the present invention may also be made by adding the respective components in alternate orders than the foregoing example.

The sensitivity of the primer compositions in Examples 1-6 were tested with the results provided in Table 9. The sensitivity test of the Example 1 primer composition was conducted according to small pistol, 9 mm NATO specifications, 1.94 oz. ball/0.078 inch diameter pin. The sensitivity tests of Example 2, Example 4, and Example 6 primer compositions were conducted according to small rifle, U.S. military specifications, 3.94 oz. ball/0.060 inch diameter pin. The sensitivity test of the Example 3 primer composition was conducted according to large rifle, U.S. military specifications, 3.94 oz. ball/0.078 inch diameter pin. The shotshell sensitivity test of the Example 5 primer composition was conducted according to SAAMI.

TABLE 9

Example Percussion Primer Compositions

| Specification (inches) | Ex. 1 | Ex. 2 | Ex. 3 | Ex. 4 | Ex. 5 | Ex. 6 |
|---|---|---|---|---|---|---|
| All Fire | 7 | 10 | 9 | 8 | 5 | 7 |
| All Miss | 4 | 6 | 4 | 4 | 2 | 3 |
| H-bar | 5.46 | 7.50 | 6.64 | 5.98 | 3.14 | 5.02 |
| Std. Dev. | 0.72 | 0.85 | 1.06 | 0.64 | 0.79 | 0.70 |
| H + 5 | 9.06 | — | 11.93 | — | — | — |
| H − 2 | 4.02 | — | 4.52 | — | — | — |
| H + 3 | — | 10.05 | — | 7.90 | — | 7.12 |
| H − 3 | — | 4.95 | — | 4.06 | — | 1.92 |
| H + 4 | — | — | — | — | 6.32 | — |
| H − 2 | — | — | — | — | 1.55 | — |

For the data in Table 9, the respective specifications also have specification limits. The specification limits applicable to Example 1 are the H+5 standard is less than or equal to 12 inches, and the H−2 standard is greater than or equal to 3 inches. The specification limits applicable to Example 2, Example 4 and Example 6 are the H+3 standard is less than or equal to 12 inches, and the H−3 standard is greater than or equal to 3 inches. The specification limits applicable to Example 3 are the H+5 standard is less than or equal to 15 inches, and the H−2 standard is greater than or equal to 3 inches. The specification limits applicable to Example 5 are H+4 standard is less than or equal to 14 inches, and the H−2 standard is greater than or equal to 1 inch.

As provided in the foregoing sensitivity testing data in Table 9, the primer compositions of Examples 1-7 meet the respective testing specification criteria.

As illustrated in Table 10, the comparative ballistics data indicate that performance characteristics of the primer compositions of the present invention, as indicated by velocity and pressure, are about equal to or better than that of conventional lead styphnate based primers. The moderately low standard deviations of the primer compositions of the present invention also indicate that consistent results are observed. In obtaining the comparative ballistic data, the control ammunitions used military-spec compliant loaded ammunitions with a conventional lead styphnate based primer. The primer is the only variable between the control ammunitions and the example ammunitions, as no adjustments were made from a standard case, projectile, propellant or propellant charge. In obtaining the comparative ballistic data for the primer compositions of the present invention and the respective control primers, 9 mm NATO specifications were used for the ammunition containing the primer composition of Example 1 and the Control M882, 5.56 mm U.S. military specifications were used for the ammunition containing the primer composition of Example 2 and the Control M193, 7.62 mm U.S. military specifications were used for ammunition containing the primer composition of Example 3 and the Control M80, and 12 gauge shotshell SAAMI specification was used for ammunition containing the primer composition of Example 5 and Control.

TABLE 10

| Sample | Velocity (m/s)* (f/s) | Velocity Std Dev | Pressure (psi) | Pressure range | Peak Pressure Time (μs) | Port Pressure (psi) |
|---|---|---|---|---|---|---|
| Ex. 1 (small pistol) | 390* | 0.7 | 24,144 | 3708 | 241 | — |
| Control 1 (M882) | 389* | 1 | 24,655 | 3893 | 242 | — |
| Ex. 2 (small rifle) | 3191 | 13 | 57,015 | 4332 | 921 | 16,983 |
| Control 2 (M193) | 3132 | 13 | 53,280 | 2575 | 956 | 16,893 |
| Ex. 3 (large rifle) | 2780 | 50 | 55,793 | 5187 | 1407 | 11,172 |
| Control 3 (M80) | 2783 | 37 | 57,297 | 4013 | 1298 | 11,206 |
| Ex. 5 (shotshell) | 1155 | 35 | 8150 | 1196 | — | — |
| Control 5 (shotshell) | 1156 | 16 | 8581 | 1049 | — | — |

Table 11 indicates the results of thermal stability over time at 175° F. when tested in a 9 mm shell case. The control group contains a traditional primer composition utilizing lead styphnate as the primary explosive.

TABLE 11

| Days at | CONTROL | | EX. 1 | |
|---|---|---|---|---|
| 175° F. | Velocity | Pressure | Velocity | Pressure |
| 0 | 998 | 33,124 | 983 | 32,069 |
| 11 | 987 | 32,860 | 1036 | 37,889 |
| 20 | 966 | 32,177 | 1048 | 39,896 |
| 32 | 959 | 31,552 | 1056 | 40,917 |
| 40 | 918 | 29,467 | 1057 | 41,493 |
| 49 | 811 | 22,802 | 1066 | 43,236 |
| 60 | 710 | 13,417 | 1028 | 40,966 |

For the test data in Table 11, all of the data was obtained under the same circumstances with the primer composition being the only variable between the ammunition of the control group and the ammunition containing the primer composition of the present invention. In each case, the primer composition according to one embodiment of the present invention are about equal to or better than the values of the control group containing a traditional primer composition utilizing lead styphnate as the primary explosive. It will be noted that the values of the primer composition of Example 1 shows that the expected ballistics data increases as propellant moisture and volatiles evaporated, which continues and then stabilizes at the higher pressure. This phenomenon is also observed with the control primer for the common 150° F. test. Thermal stability at 175° F. has been shown to be a much better indicator than the common 150° F. test, as it accelerates potential primer composition component interactions and degradation issues not necessarily seen at 150° F.

As previously discussed, the present invention finds utility in any application where igniters or percussion primers are employed. Such applications typically include an igniter or percussion primer, a secondary explosive, and for some applications, a propellant.

As previously mentioned, other applications include, but are not limited to, igniters for grenades, mortars, detcord initiators, mortar rounds, detonators such as for rocket motors and mortar rounds, or other systems that include a primer or igniter, a secondary explosive system, alone or in combination with a propellant, or gas generating systems.

The above disclosure is intended to be illustrative and not exhaustive. This description will suggest many variations and alternatives to one of ordinary skill in this art without departing from the scope of the present invention. All these alternatives and variations are intended to be included within the scope of the attached claims. Those familiar with the art may recognize other equivalents to the specific embodiments described herein which equivalents are also intended to be encompassed by the claims attached hereto.

What is claimed:

1. A primer composition comprising:

a composite explosive, the composite explosive component comprising:

nitrocellulose fibers and at least one fuel component, the at least one fuel component having an average particle size of about 3 microns to about 12 microns;

wherein the primer composition is substantially devoid of a traditional primary explosive including lead styphnate, metal azides, mercury fulminate, and dinitrophenol.

2. The primer composition of claim 1, wherein the at least one fuel component is selected from the group consisting of aluminum, boron, molybdenum, titanium, tungsten, magnesium, melamine, zirconium, calcium silicide, and mixtures thereof.

3. The primer composition of claim 1 further comprising an oxidizer selected from the group consisting of bismuth trioxide, bismuth subnitrate, bismuth tetroxide, bismuth sulfide, zinc peroxide, tin oxide, manganese dioxide, molybdenum trioxide, potassium nitrate, and combinations thereof.

4. The primer composition of claim 1, the at least one fuel component in an amount of about 5 wt-% to about 25 wt-% based on the dry weight of the primer composition.

5. The primer composition of claim 1, the nitrocellulose fibers in an amount of about 5 wt-% to about 25 wt-% based on the dry weight of the primer composition.

6. The primer composition of claim 5, the nitrocellulose fibers having a nitrogen content of about 12.5 wt-% to about 13.6 wt-%.

7. The primer composition of claim 1, the composite explosive component further comprising a moderately insensitive explosive selected from the group consisting of pentaerythritol tetranitrate ("PETN"), 2,4,6,8,10,12-hexanitro-2,4,6,8,10,12-hexaazatetracyclo [5.5.0.0.$^{5,9}$0$^{3,11}$]-dodecane ("CL-20"), cyclo-1,3,5-trimethylene-2,4,6-trinitramine ("RDX"), cyclotetramethylene tetranitramine ("HMX"), 2,4,6-trinitrotoluene ("TNT"), nitroguanidine, styphnic acid, potassium dinitrobenzofuroxan ("KDNBF"), and mixtures thereof.

8. The primer composition of claim 1, further comprising tetracene in an amount of 0 wt-% to about 10 wt-% based on the dry weight of the primer composition.

9. A primer composition comprising:

a composite explosive component as a primary explosive, the composite explosive component comprising at least one moderately insensitive explosive selected from the group consisting of nitrocellulose, pentaerythritol tetranitrate ("PETN"), 2,4,6,8,10,12-hexanitro-2,4,6,8,10,12-hexaazatetracyclo[5.5.0.0.$^{5,9}$0$^{3,11}$]-dodecane ("CL-20"), cyclo-1,3,5-trimethylene-2,4,6-trinitramine ("RDX"), cyclotetramethylene tetranitramine ("HMX"), 2,4,6-trinitrotoluene ("TNT"), nitroguanidine, styphnic acid, potassium dinitrobenzofuroxan ("KDNBF"), and mixtures thereof; and at least one fuel component having an average particle size of about 3 microns to about 12 microns, the at least one fuel component selected from the group consisting of aluminum, boron, molybdenum, titanium, tungsten, magnesium, melamine, zirconium, calcium silicide, and mixtures thereof;

wherein the amount of the at least one moderately insensitive explosive is about 5 wt-% to about 40 wt-% of the total weight of the composite explosive component.

10. The primer composition of claim 9, the at least one moderately insensitive explosive in an amount of about 8 wt-% to about 20 wt-% based on the dry weight of the primer composition.

11. The primer composition of claim 9, wherein the at least one moderately insensitive explosive is nitrocellulose, the nitrocellulose being nitrocellulose fibers having a nitrogen content of about 12.5 wt-% to about 13.6 wt-%.

12. The primer composition of claim 9, the at least one fuel component having an average particle size of about 3 microns to about 9 microns.

13. The primer composition of claim 9, the at least one fuel component in an amount of about 5 wt-% to about 25 wt-% based on the dry weight of the primer composition.

14. The primer composition of claim 9, further comprising bismuth trioxide in an amount of about 35 wt-% to about 70 wt-% based on the dry weight of the primer composition.

15. The primer composition of claim 9, further comprising bismuth subnitrate in an amount of about 35 wt-% to about 70 wt-% based on the dry weight of the primer composition.

16. A primer composition comprising:

a composite explosive component as a primary explosive, the composite explosive component comprising:

a moderately insensitive explosive comprising nitrocellulose and at least one component selected from the group consisting of pentaerythritol tetranitrate ("PETN"), 2,4,6,8,10,12-hexanitro-2,4,6,8,10,12-hexaazatetracyclo[5.5.0.0.$^{5,9}$0$^{3,11}$]-dodecane ("CL-20"), cyclo-1,3,5-trimethylene-2,4,6-trinitramine ("RDX"), cyclotetramethylene tetranitramine ("HMX"), 2,4,6-trinitrotoluene ("TNT"), nitroguanidine, styphnic acid, potassium dinitrobenzofuroxan ("KDNBF"), and mixtures thereof; and at least one fuel component having an average particle size of about 3 microns to about 12 microns, the at least one fuel component selected from the group consisting of aluminum, boron, molybdenum, titanium, tungsten, magnesium, melamine, zirconium, calcium silicide, and mixtures thereof.

17. The primer composition of claim 16, the nitrocellulose and the at least one moderately insensitive explosive in an amount of about 8 wt-% to about 40 wt-% based on the dry weight of the primer composition.

18. The primer composition of claim 16, wherein the nitrocellulose is nitrocellulose fibers having a nitrogen content of about 12.5 wt-% to about 13.6 wt-%.

19. The primer composition of claim 16, the at least one fuel component in an amount of about 5 wt-% to about 25 wt-% based on the dry weight of the primer composition.

20. The primer composition of claim 16, further comprising an oxidizer selected from the group consisting of bismuth trioxide, bismuth subnitrate, bismuth tetroxide, bismuth sulfide, zinc peroxide, tin oxide, manganese dioxide, molybdenum trioxide, potassium nitrate, and combinations thereof.

21. A primer composition comprising:

a composite primary explosive consisting essentially of nitrocellulose fibers and a fuel component chosen from aluminum, boron, molybdenum, titanium, tungsten, magnesium, melamine, zirconium, calcium silicide, and mixtures thereof, the fuel component having an average particle size from about 3 microns to about 12 microns; and an oxidizer;

wherein the primer composition is substantially devoid of a traditional primary explosive including lead styphnate, metal azides, mercury fuminate, and dinitrophenol.

22. The primer composition of claim 21, wherein the nitrocellulose fibers comprises less than 20 wt-% based on the dry weight of the primer composition.

23. The primer composition of claim 21, further comprising tetracene in an amount of 0 wt-% to about 10 wt-% based on the dry weight of the primer composition.

24. The primer composition of claim 21, wherein the oxidizer is chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

25. A primer composition comprising:

a composite primary explosive consisting essentially of nitrocellulose fibers, at least one moderately insensitive explosive chosen from pentaerythritol tetranitrate ("PETN"), 2,4,6,8,10,12-hexanitro-2,4,6,8,10,12-hexaazatetracyclo[5.5.0.0.$^{5,9}$0$^{3,11}$]-dodecane ("CL-20"), cyclo-1,3,5-trimethylene-2,4,6-trinitramine ("RDX"), cyclotetramethylene tetranitramine ("HMX"), 2,4,6-trinitrotoluene ("TNT"), nitroguanidine, styphnic acid, potassium dinitrobenzofuroxan ("KDNBF"), and a fuel component, the fuel component having an average particle size from about 3 microns to about 12 microns; and an oxidizer;

wherein the primer composition is substantially devoid of a traditional primary explosive including lead styphnate, metal azides, mercury fuminate, and dinitrophenol.

26. The primer composition of claim 25, wherein the nitrocellulose fibers comprises less than 20 wt-% based on the dry weight of the primer composition.

27. The primer composition of claim 25, further comprising tetracene in an amount of 0 wt-% to about 10 wt-% based on the dry weight of the primer composition.

28. The primer composition of claim 25, wherein the oxidizer chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

29. The primer composition of claim 25, wherein the oxidizer is bismuth trioxide having an average particle size of about 10 microns to about 200 microns.

* * * * *